US005347193A

United States Patent [19]

Oshima et al.

[11] Patent Number: 5,347,193

[45] Date of Patent: Sep. 13, 1994

[54] SPARK PLUG HAVING AN EROSION RESISTANT TIP

[75] Inventors: Takafumi Oshima; Kazuya Iwata; Tsutomu Okayama, all of Nagoya, Japan

[73] Assignee: NGK Spark Plug Co., Ltd., Nagoya, Japan

[21] Appl. No.: 960,113

[22] Filed: Oct. 13, 1992

[51] Int. Cl.[5] ..... H01T 13/20; H01T 13/39

[52] U.S. Cl. ..... 313/141; 313/142; 313/143

[58] Field of Search ..... 313/141, 142, 143; 123/164 R

[56] References Cited

U.S. PATENT DOCUMENTS

| | | | |
|---|---|---|---|
| 2,955,222 | 1/1960 | Beesch et al. . | |
| 3,146,370 | 8/1964 | Van Duyne et al. . | |
| 4,700,103 | 10/1987 | Yamaguchi et al. | 313/142 |
| 4,771,210 | 9/1988 | Möhle et al. | 313/141 |

FOREIGN PATENT DOCUMENTS

WO8901717 2/1989 World Int. Prop. O. .

*Primary Examiner*—Donald J. Yusko

*Assistant Examiner*—N. D. Patel

*Attorney, Agent, or Firm*—Cooper & Dunham

[57] ABSTRACT

In a center electrode for a spark plug, the center electrode is made of a heat-conductor core cladded with a nickel-alloyed metal. A recess is provided on the front end surface of the nickel-alloyed matrix and the columnar tip is made of a precious metal and fit in the recess in such a manner that a front end of the tip protracts from the recess. The outer surface of the tip is welded to an inner surface of the recess. The dimensional relationship of the components of the spark plug A, B, C, D, E, F and G is as follows: 0.3 mm≦A≦0.8 mm, 1.2A≦B≦3A, 0.1 mm≦(C-A)/2≦0.5 mm, D≦(C-A)/2, E≦B/4, 0 mm≦F≦0.5 mm and A/5≦G≦A/2, where A: a diameter of the columnar tip, B: a length of the columnar tip, C: a diameter of a front end of the nickel-alloyed metal, D: a length of a front end of the nickel-alloyed metal, E: a length of the front end of the tip which is protracted from the recess, F: a distance between a rear end of the tip and a front end of the heat-conductor core, G: a distance of a welding portion penetrated from the outer surface of the tip into the inner surface of the recess.

4 Claims, 12 Drawing Sheets

SPARK PLUG HAVING AN EROSION RESISTANT TIP

BACKGROUND OF THE INVENTION

Field of the Invention

This invention relates to a spark plug in which an erosion-resistant tip is secured to a front end of a center electrode by means of welding.

In a center electrode for a spark plug for use in an internal combustion engine, in order to provide the center electrode with heat-and oxidation-resistant property, the center electrode has a nickel-based metal in which a copper core is embedded as a heat-conductor core.

Further, a tip which is made of precious metal such as platinum-based alloy is welded to an front end of the center electrode so as to improve spark-erosion resistance.

In related prior arts, U.S. Pat. No. 3,146,370 suggests a center electrode for a spark plug in which a tip is welded to a firing portion of the center electrode in which the tip has a cobalt (Co) core cladded by an iridium (It) sheath.

In a Japanese Patent Application No. 1-314315 filed by the applicant of the invention, an inventor suggests an optimal dimensional relationship between a tip and a recess in which an iridium-based tip is fit in a recess provided at a front end surface of a center electrode, and the tip is secured to an outer wall of the recess by means of laser or electron beam welding.

With high speed and high power requirement of the internal combustion engine, the front end of the center electrode tends to be exposed to higher ambient temperature. In order to protect the tip against thermal deterioration, it is necessary to prevent the temperature of the tip from abnormally rising. The iridium-made tip, a melting point of which is as high as 2500° C., has remarkable spark-erosion resistant property. The tip, however, deteriorates due to evaporation when oxidized by being exposed to the high ambient temperature of more than 900° C.

In addition, a distance between a rear end of the tip and a front end of the copper core is 1.0 mm or more, and therebetween lies a part of the nickel-alloyed sheath which is relatively poor in thermal conductivity.

This blocks to thermally transmit a sufficient amount of heat from the tip to a rear end of the center electrode by way of the copper core so as to deteriorate a heat-conductive property when the tip is exposed to a combustion chamber of the internal combustion engine. For this reason, temperature of the tip is likely to excessively rise particularly when the engine runs at high speed with high load.

When the tip is bonded directly to the front end of the copper core by means of electrical resistance welding, the front end of the copper core is likely to outcrop from the nickel-alloyed sheath due to their thermal expansional difference, and oxidized in the higher atmospheric ambience.

Therefore, it is an object of the invention to provide a center electrode for a spark plug which is capable of effectively preventing the temperature of a tip from abnormally rising so as to keep the tip firmly in place without falling the tip off the recess by thermal damage of the welding portion, and contributing to an extended service life with relatively low cost. In a center electrode for a spark plug, a tip is fitted in a recess provided on a front end surface of the nickel-alloy metal, and the tip is in such a manner that a front end of the tip is protracted from the recess, and an outer surface of the tip is bonded to an inner surface of the recess by means of laser or electron beam welding.

SUMMARY OF THE INVENTION

According to the invention, there is provided a center electrode for a spark plug, a relationship between a diameter (A) of the tip and (G) is $A/5 \leqq G \leqq A/2$ so that the strength of the welding portion is significantly enhanced, where (G) is a distance of a welding portion penetrated from the outer surface of the tip to the inner surface of the recess which is provided on a front end surface of the nickel-alloyed metal when an outer surface of the tip is bonded to an inner surface of the recess by means of laser or electron beam welding.

This effectively prevents the tip from falling off the nickel-alloyed metal when the tip is subjected to a thermal stress in a direction in which the heat-conductor core is pushed by the nickel-alloyed metal due to the thermal expansional difference between the heat-conductor core and the nickel-alloyed metal.

By way of the heat-conductor, a considerable amount of heat to which the tip is sujected is promptly transmitted to a rear end of the center electrode. The heat transmitted from the center electrode is transferred to a cylinder head through an insulator and a metallic shell, thus keeping the temperature of the tip from abnormally rising so as to secure good heat-dissipating effect.

With the employment of an inexpensive iridium-based tip which has a relatively high melting point and superior in spark-erosion resistant property, the good heat-dissipating effect compensates drawback of the iridium-based tip in which the tip is likely to evaporate by oxidation at 900°~1000° C.

Furthermore, upon preparing the metallic oxide such as oxide of aluminum (Al), magnesium (Mg) or thorium (Th) each of which has a melting point of 2000° C. or more, the tip is made by dispersing the metallic oxide into iridium (Ir), thus making it possible to effectively prevent the evaporation of the iridium-based tip due to oxidation. In this instance, an oxide or oxides of rare earth metal (Y, La, Ce) in less than 15.0 vol % may be dispersed together with irudium (Ir) to form a sintered complex body.

The ground elecrode is provided to form a spark gap, and the ground electrode has a tip made of a platinum metal, iridium metal, nickel-platinum alloy or nickel-iridium alloy.

Moreover, an addition of nickel to the outer electrode makes it possible to diminish the thermal expansional difference between the tip and the outer electrode, thus preventing the tip from falling off the outer electrode their thermal expansional difference, and contributing to an extended period of service life.

These and other objects and advantages of the invention will be apparent upon reference to the following specification, attendant claims and drawings.

DETAILED DESCRIPTION OF THE EMBODIMENTS

Figure 1:
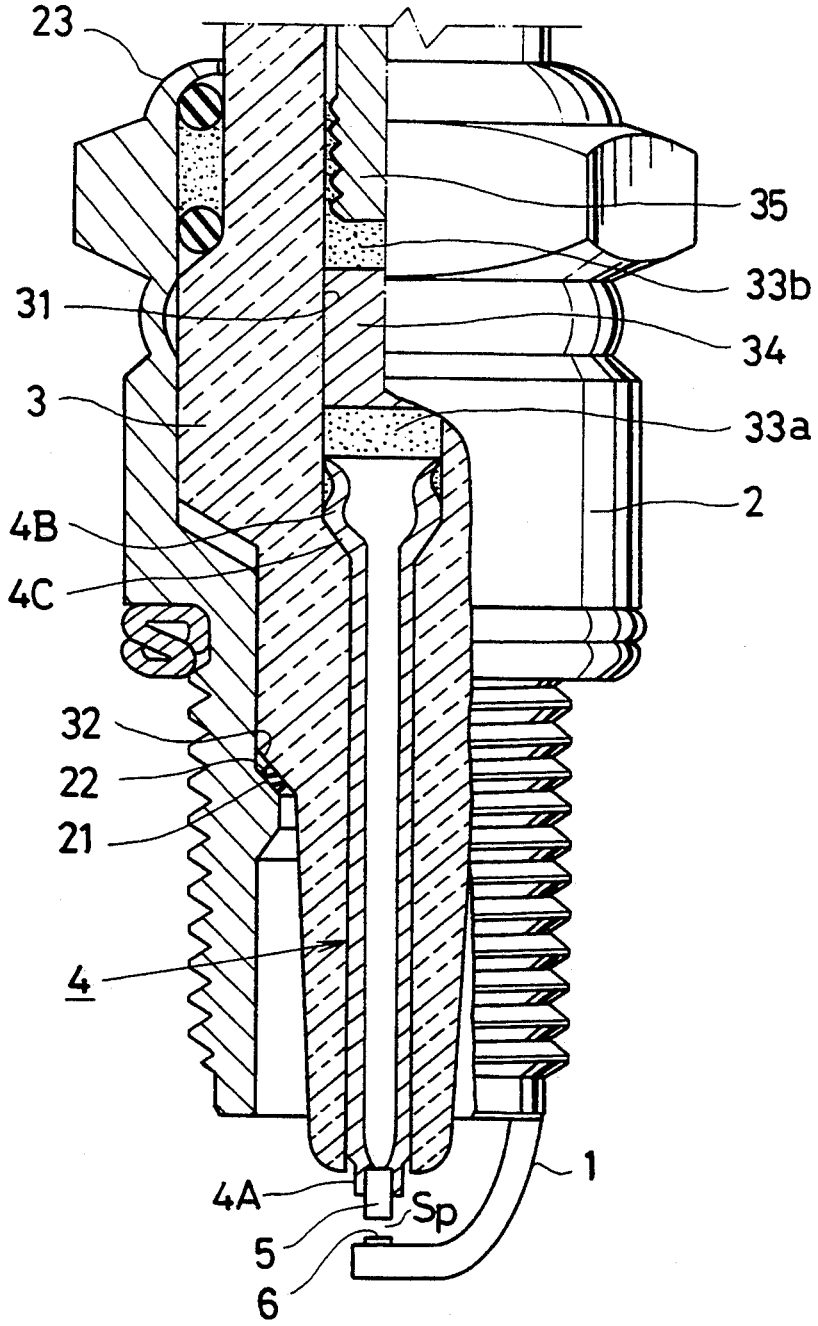
FIG. 1 is a cross sectional view of a spark plug, but its upper part is broken away.

Referring to FIG. 1 which substantially shows a lower half portion of a spark plug, the spark plug has a cylindrical metallic shell 2, to a front end of which a L-shaped outer electrode 1 is fixedly attached by means of welding. Within the metallic shell 2, is a tubular insulator 3 is placed, an inner space of which serves as an axial bore 31. The insulator 3 has a shoulder 32 which is, by way of a packing 22, received by a stepped portion 21 provided with an inner wall of the metallic shell 2 so as to support the insulator 3 within the metallic shell 2. A rear head 23 of the metallic shell 2 is inturned to engage against an outer surface of the insulator 3 by means of caulking to secured the insulator 3 against removal.

Within the axial bore 31 of the insulator 3, is a center electrode 4 placed whose front end 4A somewhat diametrically reduced, and extends beyond that of the insulator 3. A rear end 4B of the center electrode 4 is brought into engagement with a stepped shoulder 4C which is provided with an inner wall of the axial bore 31. To a rear end of the center electrode 4, is a middle axis 35 connected by way of a monolithic resistor 34 is interposed between glass sealants 33*a*, 33*b*.

Meanwhile, the outer electrode 1 is made of nickel or nickel-based alloy to which a tip 6 is welded in correspondece with a tip 5 as described hereinafter so as to form a spark gap (Sp) with the tip 5. The tip 6 is made of platinum (Pt), iridium (It) or alloy of platinum (Pt) and nickel (Ni), in which a ratio of nickel (Ni) ranges from 10.0 wt % to 40.0 wt %.

Figure 2:
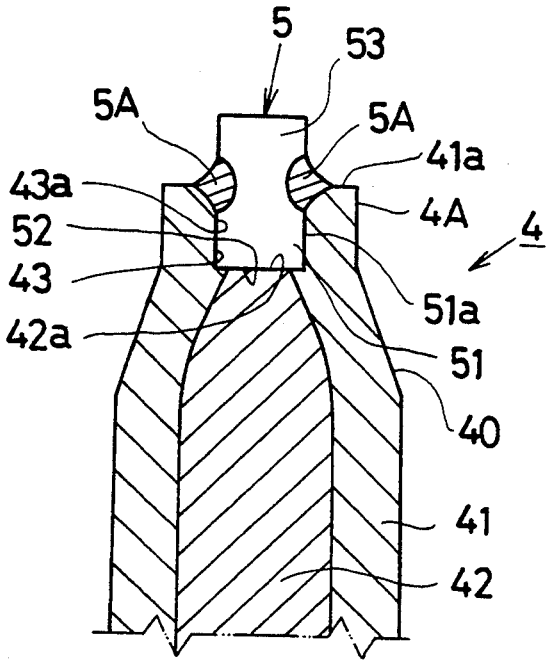
FIG. 2 is an enlarged cross sectional view of a front end of a center electrode according to one embodiment of the invention.

As shown in FIG. 2, the center electrode 4 is made of a nickel-alloyed metal 41 including 15.0 wt % chromium and 8.0 wt % iron. In the nickel-alloyed metal 41, is a copper or silver core embedded as a heat-conductor core 42 to form a composite structure 40.

A recess 43 is provided on an front end surface 41*a* of the nickel-based metal 41 in such a manner as to reach a front end 42*a* of the heat-conductor core 42. In the recess 43, is a rear portion 51 of the tip 5 fitted in such a manner that a front end 53 of the tip 5 is somewhat protracted from the recess 43.

Figure 3:
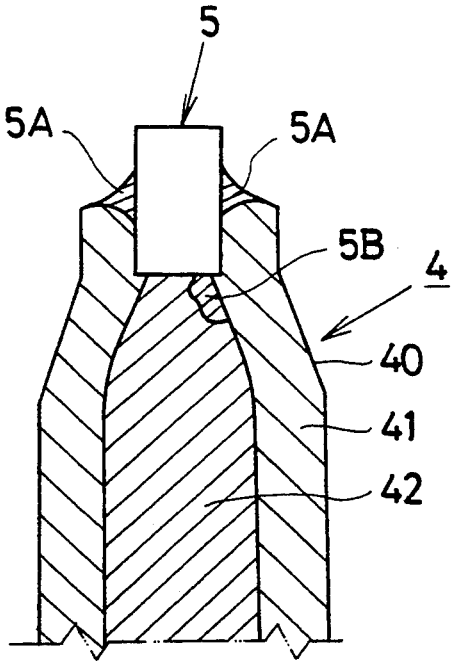
FIG. 3 is similar to FIG. 2 to show an oxidation part of a heat-conductor core.

In this instance, the rear end 52 of the tip 5 is in thermally transferable contanct with a front end 42*a* of the heat-conductor core 42. An outer surface 51*a* of the tip 5 is thermally bonded to an inner surface 43*a* of the recess 43 by means of laser or electron beam welding as designated at 5A. The welding portion 5A prevents an entry of the combustion gas against the heat-conductor core 42, and protecting the core 42 against corrosion an erosion due to oxidation as shown at 5B in FIG. 3.

It is observed that before the laser or electron beam welding is carried out, an electrical resistance welding may be provisionally done between the tip 5 and the inner surface 43*a* of the recess 43 so as to enhance the strength of the welding portion 5A, and at the same time, strengthening the thermally transferable contact between the tip 5 and the heat-conductor core 42, thus enabling to good heat-dissipating effect.

Figure 4:
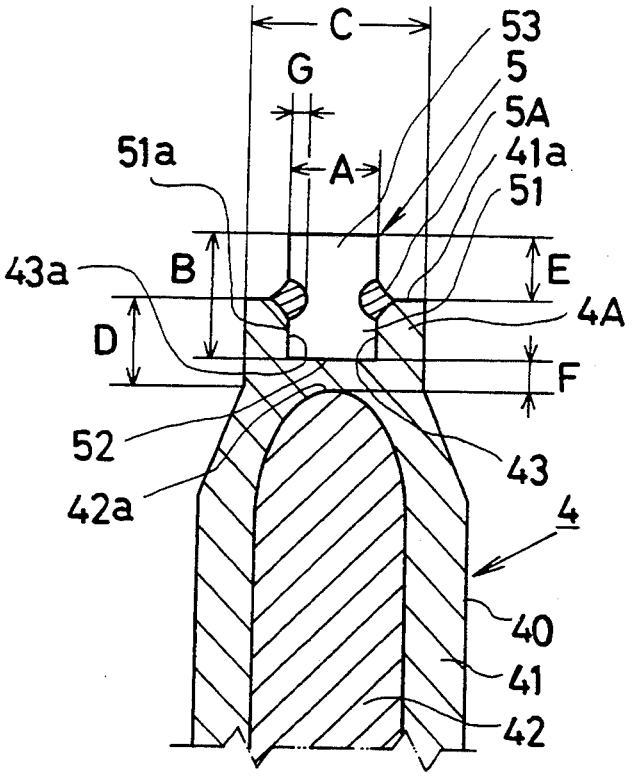
FIG. 4 is similar to FIG. 2 according to another embodiment of the invention.

As shown in FIG. 4, a dimensional relationship of A, B, C, D, E and F is as follows:

$0.3\ mm \leqq A \leqq 0.8\ mm$, $1.2A \leqq B \leqq 3A$, $0.1\ mm \leqq (C-A)/2 \leqq 0.5\ mm$, $D \leqq (C-A)/2$, $E \geqq B/4$, $0\ mm \leqq F \leqq 0.5\ mm$ and $A/5 \leqq G \leqq A/2$.

Where

A: a diameter of the columnar tip 5,

B: a length of the columnar tip 5,

C: a diameter of the front end 4A of the nickel-alloyed metal 41,

D: a length of the front end 4A of the nickel-alloyed metal 41,

E: a length of the front portion 53 of the tip 5 which is protracted from the recess 43, F: a distance between the rear end 52 of the tip 5 and the front end 42*a* of the heat-conductor core 42, G: a distance of a welding portion 5A penetrated from the outer surface 51*a* of the tip 5 to the inner surface 43*a* of the recess 43 when the tip 5 is bonded to the inner surface 43*a* of the recess 43 by means of laser or electron beam welding.

Figure 5:
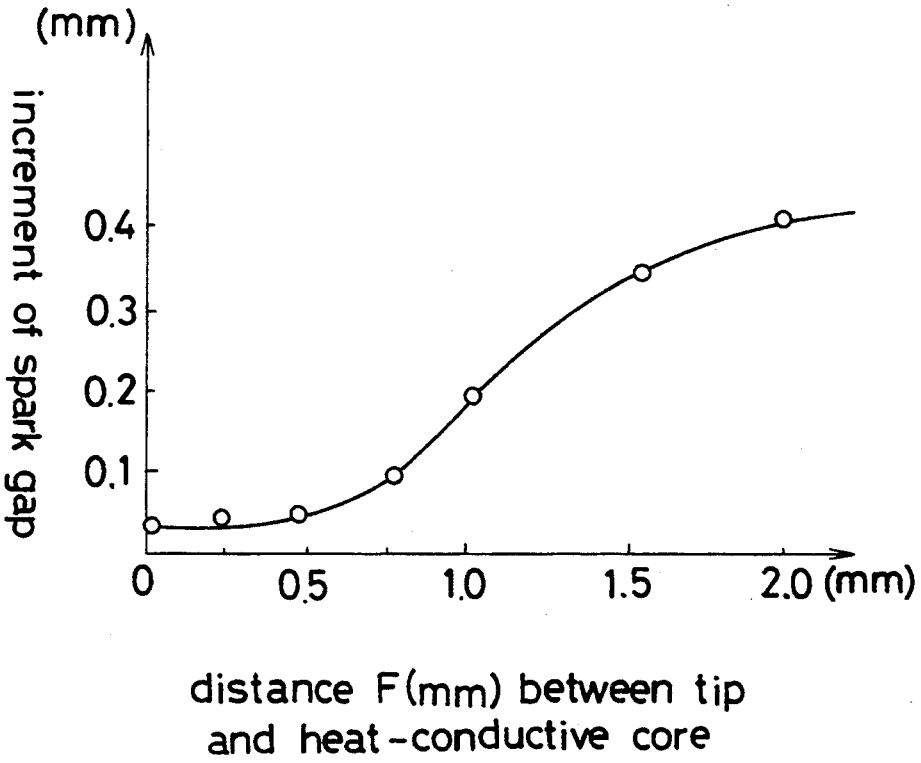
FIG. 5 is a graph showing a relationship how a spark gap changes depending on a distance (F mm) between the tip and a heat-conductive core.

FIG. 5 shows how the spark gap (Sp) changes depending on the distance (F) between the rear end 52 of the tip 5 and the front end 42*a* of the heat-conductor core 42. This is obtained after carrying out a spark-erosion resistance test at full load and 5500 rpm for 200 hours with the spark plug mounted on a six-cylinder, 2000 cc engine. It is found from FIG. 5 that an amount of spark-erosion is least when the distance (F) is less than 0.5 mm which indicates the least increment of the spark gap (Sp).

The upper limit of the diameter (A) is 0.8 mm because the diameter (A) exceeding 0.8 mm prevents the compactness of the tip 5, and iridium (Ir) or iridium-based alloy has spark-erosion resistance more superior than platinum-based alloy including 20.0 wt % iridium.

The lower limit of the diameter (A) is 0.3 mm because the diameter (A) less than 0.3 mm fails to ensure minimum necessary spark gap.

The formula is determined as $1.2A \leqq B \leqq 3A$ (preferably $1.5\ mm \leqq B \leqq 2.0\ mm$) because it is necessary to obtain the length of the tip 5 protracted from the recess 43 with minimum cost of expensive iridium ensured.

The relationship is determined as $0.1\ mm \leqq (C-A)/2 \leqq 0.5\ mm$ (preferably $0.1\ mm \leqq (C-A)/2 \leqq 0.3\ mm$)

because when (C-A)/2 exceeds 0.5 mm, the enlarged diameter (C) diverts the incidence energy of the laser welding to the front end surface 41*a* of the nickel-alloyed metal 41, which decreases the formation of the welding portion 5*a* (Ir - Ni alloyed layer) 5A so as to lose the firmness between the outer surface 51*a* of the tip 5 and the inner surface 43*a* of the recess 43.

When (C-A)/2 is less than 0.1 mm, the lessened diameter (C) allows the spark discharge to erode the welding portion 5*a* (Ir - Ni alloyed layer) 5A so as to lose the firmness between the outer surface 51*a* of the tip 5 and the inner surface 43*a* of the recess 43.

The formula is determined as $D \leqq (C-A)/2$ because greater amount of the length (D) makes it impossible to sufficiently supply the incident energy of the laser welding to the rear end 52 of the tip 5 so as to lose the sufficient strength of the welding portion 5A.

The protracted length (E) of the tip 5 is $E \geqq B/4$ mm because it is necessary to prevent the front portion 53 of the tip 5 from being embedded by the welding portion 5A, and to serve the tip 5 for an extended period of time.

Figure 6A:
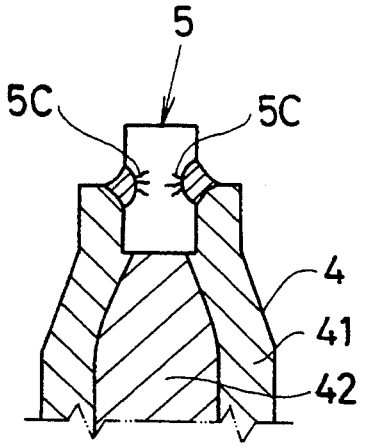
FIG. 6*a* is a cross sectional view of a front end of a center electrode to show an appearance of cracks.
Figure 6B:
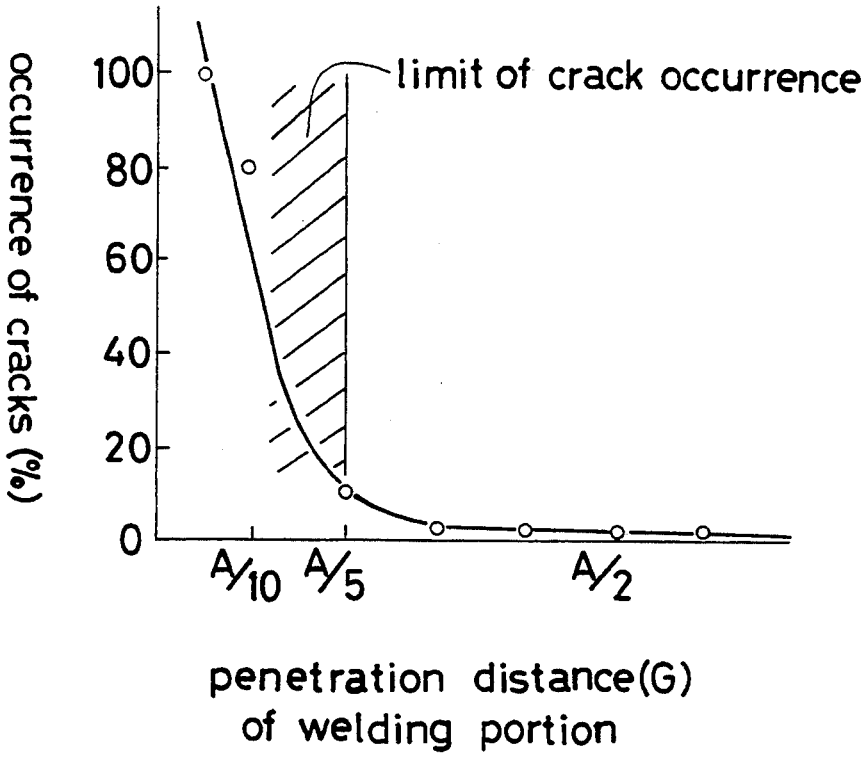
FIG. 6*b* is a graph showing a relationship between an occurrence of cracks and permeation distance (G) of a welding portion.

FIG. 6*a* is a longitudinal cross sectional view of a front portion of the center electrode 4 to show cracks 5C. FIG. 6*b* shows a relationship between an occurrence of cracks (%) and the penetration distance (G) of the welding portion 5A.

This is obtained after carrying out a spark-erosion resistance experiment at 5500 rpm by repeatedly running at full load×1 min. and idling×1 min. alternately for 100 hours with the spark plug mounted on a six-cylinder, 2000 cc engine. It is found from FIG. 6*b* that the occurrence of cracks abruptly increases when the penetration distance (G) is less than A/5.

This is because the welding portion 5A can't sufficiently work as stress relieving layer which absorbs the thermal expansional difference between the tip 5 and the front portion 4A of the nickel-alloyed metal 41. As a result, the cracks 5C are likely to circumferentially occur due to the thermal expansional difference between the tip 5 and the front portion 4A of the nickel-alloyed metal 41.

Figure 7:
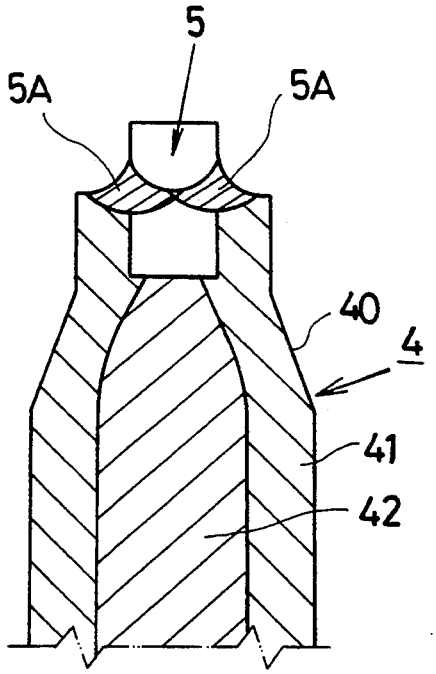
FIG. 7 is similar to FIG. 2 to show a drawback when (G) exceeds (A/2)

On the other hand, the permeation distance (G) exceeding A/2 concentrates the energy of the laser welding into the tip 5 to melt too much of the tip 5 and the front portion 4A of the nickel-alloyed metal 41 as shown in FIG. 7.

Figure 8:
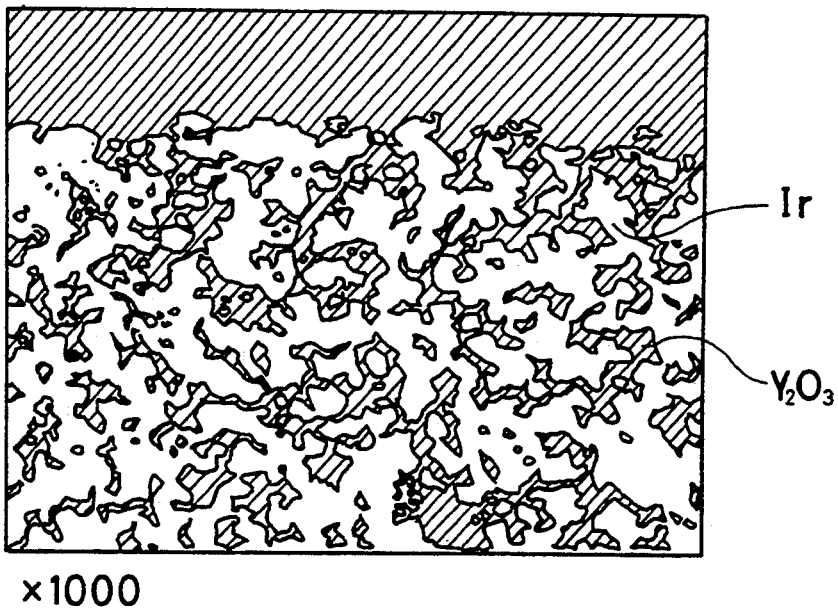
FIG. 8 is microscopic photograph showing the front end of the center electrode.

The tip 5 is made by sintering a mixture of 95.0 vol % iridium powder and 5.0 vol % yttrium oxide ($Y_2O_3$) powder (oxide of rare earth metal). The sintered tip 5 forms a Cermet in which the yttrium oxide (darkened area) is dispersed into grain boundary of the iridium (blank area) as shown at a microscopic photograph in FIG 8.

In this instance, the addition of the yttrium oxide ($Y_2O_3$) ranges from 0.1 vol % to 15.0 vol %, preferably ranging from 1.0 vol % to 10.0 vol %. Instead of the yttrium oxide ($Y_2O_3$). It is noted that thorium oxide ($ThO_2$) or lanthanum oxide ($La_2O_3$) may be used as an oxide of rare earth metal, otherwise an oxide of Zr, Al or Mg may be used alone or in combination.

Figure 9A:
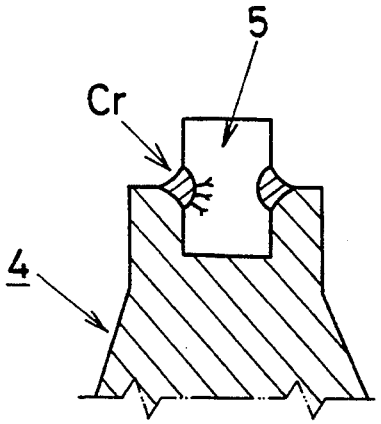
FIG. 9*a* a cross sectional view of a front end of a center electrode to show an appearance of cracks.

FIG. 9*a* is a longitudinal cross sectional view of a front portion of the center electrode 4 to show cracks (Cr). FIG. 6*b* shows a relationship between an occurrence cracks (%) and an addition of yttria ($Y_2O_3$) (vol %) of the tip 5.

Figure 9B:
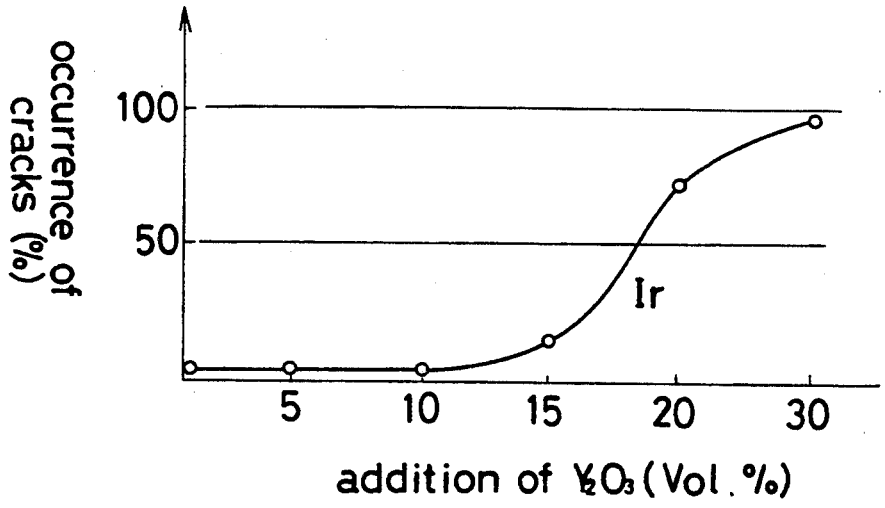
FIG. 9*b* is a graph showing a relationship between an occurrence of cracks (%) and an addition of $Y_2O_3$ (vol %)

This is obtained after carrying out spark-erosion resistance test at full load and 5500 rpm for 200 hours with the spark plug mounted on a six-cylinder, 2000 cc engine. It is found from FIG. 9*b* that the occurrence of cracks sufficiently deceases when the addition of yttria ($Y_2O_3$) (vol %) is 0.1~15.0% by volume.

Figure 10A:
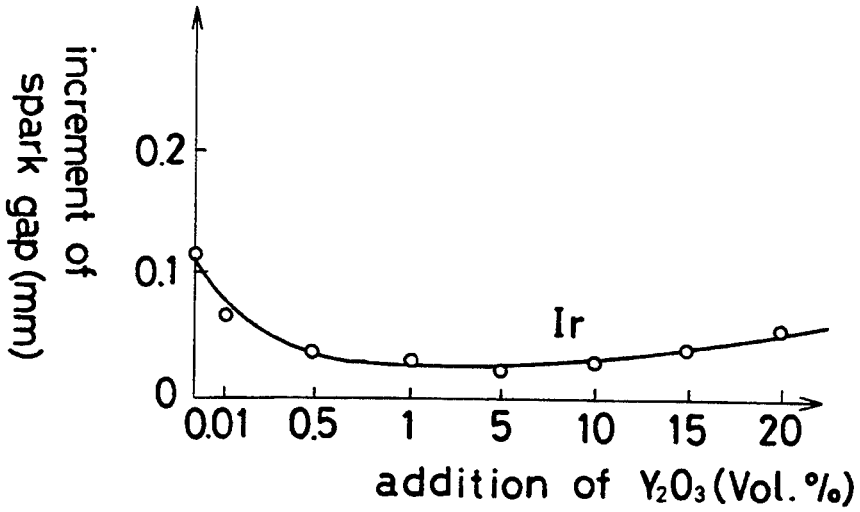
FIGS. 10*a* and 10*b* are graphs each showing how the spark gap increment (mm) changes depending upon an addition of $Y_2O_3$ (vol %)

FIG. 10*a* shows a relationship between an increment of the spark gap (Gp) an occurrence of cracks (%) and an addition of yttria ($Y_2O_3$) (vol %) of the tip 5.

This is obtained after carrying out a spark-erosion resistance experiment at full load and 5500 rpm for 200 hours with the spark plug mounted on a six-cylinder, 2000 cc engine in which the tip 5 (5.0 mm in dia.) shown in FIGS. 1 and 2 is employed. It is found from FIG. 10*a* that the evaporation of the tip is effectively prevented when the addition of yttria ($Y_2O_3$) is 0.1~15.0% by volume.

Figure 10B:
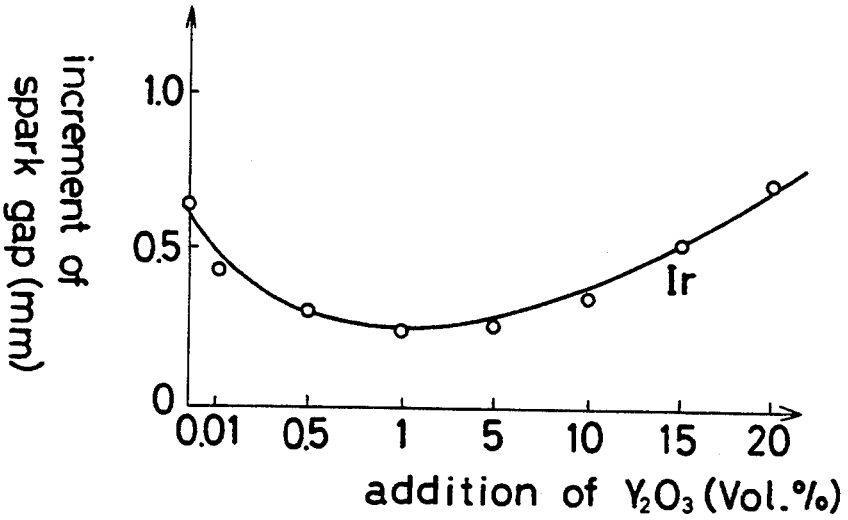

FIG. 10*b* shows a relationship between an increment of the spark gap (Gp) an occurrence of cracks (%) and an addition of yttria ($Y_2O_3$) (vol %) of the tip 5.

This is obtained after carrying out a spark-erosion resistance experiment with the spark plug activated at 50 mJ and 60 cycles/sec. for 200 hours in which the tip 5 (5.0 mm in dia.) shown in FIGS. 1 and 2 is employed. It is also found from FIG. 10*b* that the least amount of the spark erosion of the tip 5 is achieved when the addition of yttria ($Y_2O_3$) is 0.1~15.0% by volume.

If the tip is made of only iridium, the tip is likely to evaporate because the iridium is oxidized at 900° C. or more, although the iridium has a high melting point. In order to prevent the evaporation of the tip, it is necessary to prepare the oxide having a high melting or boiling point, and disperse the oxide into the iridium when sintering the tip 5.

An increased addition of the oxide makes such a structure that the iridium is dispersed into the oxide, and thus concentrating the spark discharge into the iridium to corrode the iridium since the oxide is poor in electrical conductivity. The erosion of the iridium leaves fragile mesh-like structure of the oxide which is consequently attacked by the spark discharge so as to furtherance the spark erosion.

The tip 5 is bonded to the inner surface 43*a* of the recess 43 all through their circumferences by means of laser or electron beam welding.

This is because the welding portion 5A is mechanically strengthened so as to make substantially immune to the thermal stress caused from the thermal expansional difference among the tip 5, the heat-conductor core 42 and the front portion 4A of the nickel-alloyed metal 41.

Since a negative high voltage is usually applied to the center electrode 4, heavy anode ions impinge on the tip 5 of the center electrode 4 to attack the tip 5.

On the other hand, lightweight electrons impinge on the outer electrode 1, and therefore the outer electrode 1 is eroded less than the center electrode 4.

However, the outer electrode 1 is subjected to high temperature from the combustion gas, and the tip 6 is likely to fall off the outer electrode 1 due to the thermal stress caused from the thermal expansional difference between the tip 6 and the outer electrode 1 unless the thermal expansional difference substantially remains.

In order to substantially eliminate the thermal expansional difference between the tip 6 and the outer electrode 1, nickel (Ni) is added to the tip 6. The addition of nickel less than 10.0 wt % remains the thermal expansional difference, while the addition of nickel exceeding 40.0 wt % is likely to erode the tip 6 by oxidation.

It is noted that pure iridium (Ir) or pure ruthenium (Ru) may be used to the tip 5 instead of the Cermet.

Figure 11A:
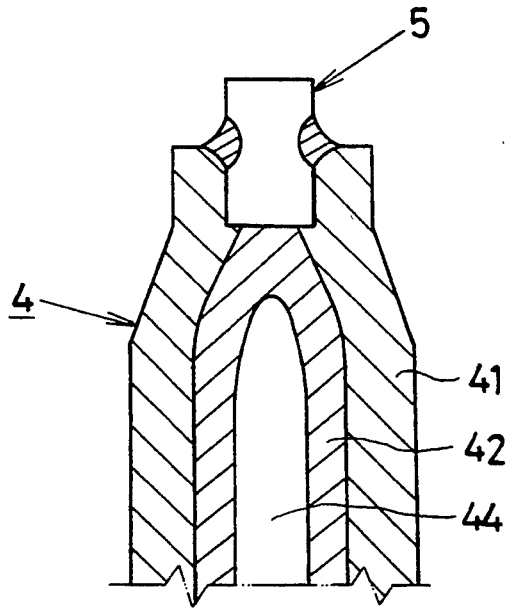
FIGS. 11*a* and 11*b* an enlarged cross sectional view of a front end of a center electrode to show modification forms of the tip.

FIG. 11*a* shows a modification form of the heat-conductor core 42 in which a centermost core 44 is cladded by the heat-conductor core 42 which is made of copper. The centermost core 44 is made of pure nickel (Ni) or pure iron (Fe). The provision of the centermost core 44 makes it possible to keep the condition of the welding portion 5A good without sacrificing the heat-dissipating effect of the heat-conductor core 42.

Figure 11B:
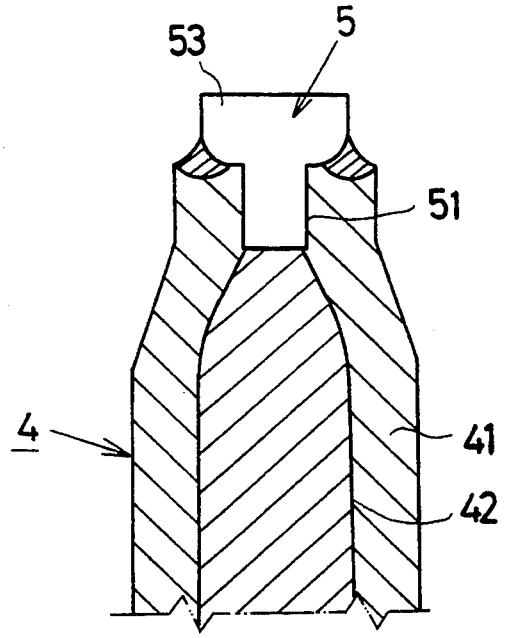

FIG. 11*b* shows another modification form of the tip 5, the front portion 53 of which is diametrically enlarged.

Figure 12A:
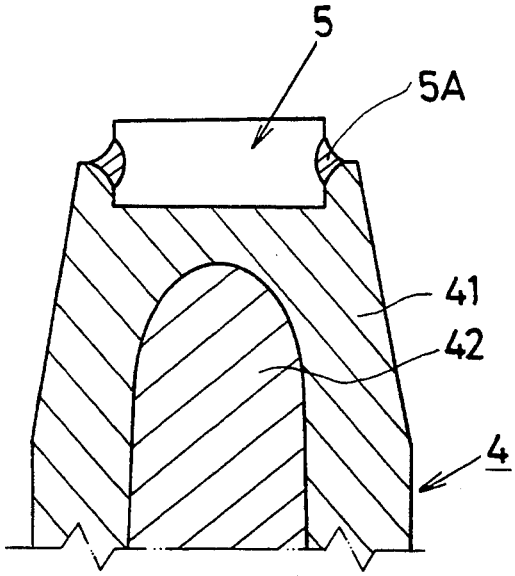
FIGS. 12*a* and 12*b* an enlarged cross sectional view of a front end of a center electrode to show modification forms of welding structure.

FIG. 12*a* shows other modification form of the tip 5 which is shaped into a disc-like configuration having a diameter of 0.8 mm or more.

Figure 12B:
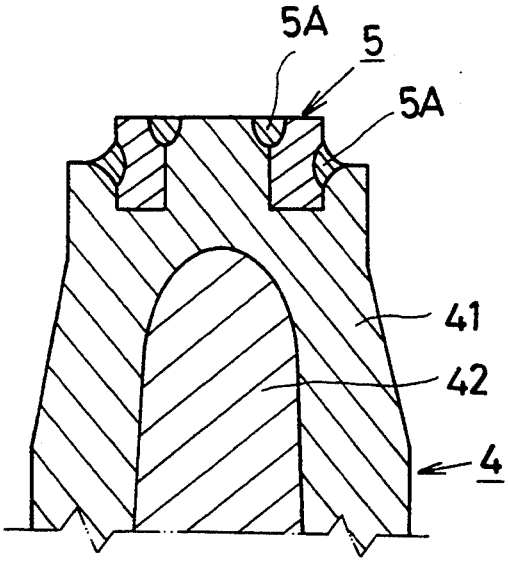

FIG. 12*b* shows other modification form of the 5 which is formed into a ring-shaped configuration having an outer diameter of 0.8 mm or more.

In each of the modification forms, the diameter of the tip 5 is 0.8 mm or more so that it is unfavorable that the discharge between the electrodes 1, 4 occurs at lowered voltage, but it is effective in keeping the temperature of the tip 5 under 900° C. and preventing a greater amount of the spark erosion.

While, the invention has been described with reference to the specific embodiments, it is understood that this description is not to be construed in a limiting sense in as much as various modifications and additions to the specific embodiments may be made by skilled artisan without departing from the spirit and scope of the invention.

What is claimed is:

1. In a spark plug electrode which includes a metallic shell having a tubular insulator in which a center electrode is provided, a front end of the center electrode forming a spark gap with an outer electrode extended from the metallic shell, the spark plug electrode comprising:

the center electrode being made of a heat-conductor core cladded by a nickel-alloyed metal;

a recess provided on a front end surface of the nickel-alloyed metal;

a columnar tip made of a precious metal, a rear end of the tip being fitted in the recess in such a manner that a front end of the tip is somewhat protracted from the recess;

an outer surface of the tip being bonded to an inner surface of the recess all through their circumference by means of laser or electron beam welding;

a dimensional relationship of A,B,C,D,E,F and G being given as follows:

$0.3\ \text{mm} \leqq A \leqq 0.8\ \text{mm}$, $1.2A \leqq B \leqq 3A$, $0.1\ \text{mm} \leqq (C-A)/2 \leqq 0.5\ \text{mm}$, $D \leqq (C-A)/2$, $E \geqq B/4$, $0\ \text{mm} \leqq F \leqq 0.5\ \text{mm}$ and $A/5 \leqq G \leqq A/2$ where A: a diameter of the columnar tip, B: a length of the columnar tip, C: a diameter of a front end of the nickel-alloyed metal, D: a length of a front end of the nickel-alloyed metal, E: a length of the front end of the tip which is protracted from the recess, F: a distance between a rear end of the tip and a front end of the heat-conductor core, G: a distance of a welding portion penetrated from the outer surface of the tip to the inner surface of the recess.

2. In a spark plug electrode as recited in claim 1 wherein, the tip is made of iridium or iridium-based alloy in which iridium is dispersed into a sintered mixture of an oxide of rare earth metal or oxide of metal selected alone or in combination from the group consisting of aluminum, magnesium and thorium, volume percentage of the oxide of the metal or the rare earth metal being in less than 15.0%.

3. In a spark plug electrode as recited in claim 2 wherein, the oxide of the metal and the rare earth metal have a melting point of more than 2000° C. or more.

4. In a spark plug electrode as recited in claim 1 wherein, a tip is placed on the outer electrode to correspond to the tip of the center electrode, the tip being made of a metal selected from the group consisting of platinum, nickel-platinum alloy, iridium and nickel-iridium alloy.

* * * * *